US007290954B2

(12) United States Patent
Kageyama et al.

(10) Patent No.: US 7,290,954 B2
(45) Date of Patent: Nov. 6, 2007

(54) AIRTIGHT CAP STRUCTURE

(75) Inventors: Hidehei Kageyama, Saitama (JP); Tomoaki Suzuki, Saitama (JP)

(73) Assignee: Kotobuki & Co., Ltd., Kawagoe, Saitama (JP)

( * ) Notice: Subject to any disclaimer, the term of this patent is extended or adjusted under 35 U.S.C. 154(b) by 0 days.

(21) Appl. No.: 11/557,572

(22) Filed: Nov. 8, 2006

(65) Prior Publication Data

US 2007/0104533 A1 May 10, 2007

(30) Foreign Application Priority Data

Nov. 9, 2005 (JP) ..... 2005-325270

(51) Int. Cl.
*B43K 5/00* (2006.01)

(52) U.S. Cl. ..... 401/202; 401/243

(58) Field of Classification Search ..... 401/107, 401/108, 202, 213, 243–248
See application file for complete search history.

(56) References Cited

U.S. PATENT DOCUMENTS 3,992,115 A * 11/1976 Culver ..... 401/106
4,969,766 A * 11/1990 Nagle et al. ..... 401/202
5,000,604 A * 3/1991 Isoda ..... 401/202
5,590,971 A * 1/1997 Melnick ..... 401/202

FOREIGN PATENT DOCUMENTS

JP 09-30187 2/1997

* cited by examiner

*Primary Examiner*—Huyen Le
(74) *Attorney, Agent, or Firm*—Miller, Matthias & Hull

(57) ABSTRACT

A airtight cap structure is capable of coming into close contact with a tip to be used and securing airtightness, even if the tip might be inserted in the cap with having a relative angle or offset between the cap and the tip. A cap comprises an outer cap and an inner cap arranged in the outer cap. The inner cap is mounted to the outer cap so that the inner cap can incline relative to the central axial line of the cap, and the cap comes into close contact with the tip or its periphery when the cap covers the tip.

7 Claims, 13 Drawing Sheets

AIRTIGHT CAP STRUCTURE

BACKGROUND OF THE INVENTION

1. Field of the Invention

The present invention relates to an airtight cap structure having a cap detachably covering a tip of an instrument such as stationeries and cosmetics for preventing the tip from drying.

2. Description of the Related Art

A conventional cap structure is described e.g. in Japanese Patent Laid-Open No. H9-30187. The cap structure described in Japanese Patent Laid-Open No. H9-30187 is a cap structure for a low-viscous ink writing instrument, wherein a cap comprises an outer cap and a cup-like sealing element fixed inside the outer cap and made of an elastic material, and a free peripheral edge of the sealing element comes into close contact with a tip periphery of an axial sleeve when the cap is mounted.

SUMMARY OF THE INVENTION

However, the cap structure described in the above publication has a limit of airtightness, even though the cup-like sealing element follows and comes into close contact with a tip to some degrees. In particular, a problem is that airtightness of the tip cannot be ensured after insertion under a condition that a relative angle or offset between the cap and the tip to be covered is not predicted.

The present invention is made in view of the above-mentioned problem, and an object of the present invention is to provide an airtight cap structure capable of coming into close contact with the tip and ensuring airtightness even under a condition that a unpredictable relative angle or offset between the cap and the tip to be covered happens.

For achieving the above-mentioned object, an airtight cap structure having a cap for detachably covering a tip to be used to prevent the tip from drying. The cap comprises an outer cap, and an inner cap installed in the outer cap. The inner cap is mounted to the outer cap so that the inner cap can incline relative to the central axial line of the cap, and the inner cap comes into close contact with the tip or its periphery when the cap covers the tip.

The inner cap can be mounted to the outer cap so as to be rotatable around an axis perpendicular to a central axial line of the cap. The cap structure can comprise a pair of shaft parts formed on any one of peripheries of the inner cap and the outer cap and extending in a radial direction, and shaft receiving holes formed on the other of the peripheries of the inner cap and the outer cap and receiving the shaft parts.

Alternatively, the inner cap can be mounted so as to be swingable around an annular part formed on the inner periphery of the outer cap. The cap structure can comprise an annular recess formed on any one of the peripheries of the inner cap and the outer cap, and a projection formed on the other of the peripheries of the inner cap and the outer cap and loosely fitted with the recess.

Alternatively, the inner cap is mounted to the outer cap so as to be pivotable around a central axial line of the cap. The cap structure can comprise a receiving part formed on any one of peak surfaces of the inner cap and the outer cap, and a pivot part formed on the other of the peak surfaces of the inner cap and the outer cap and pivoted to the receiving part.

An instrument comprises a cap having an airtight cap structure as described above, an axial sleeve holding a tip, a knocking member installed to the axial sleeve for attaching and detaching the cap, and a rotation converting mechanism connecting the cap with the knocking member. The rotation converting mechanism moves the cap forward, rotates it around an axis parallel to the axial direction, and then moves it backward, in response to one knock in an axial direction of the knocking member. Every knock of the knocking member, the cap can be switched between a condition that the cap covers the tip, and a condition that the cap exposes the tip.

According to the present invention, even if the cap approaches to the tip to cover it having a relative angle or offset, the inner cap is inclined, follows the tip, and guides the tip to a normal direction and position. Therefore, the cap can surely come into close contact with the tip or its periphery, so as to ensure airtightness.

The present disclosure relates to subject manner contained in Japanese Patent Application No. 2005-325270, filed on Nov. 9, 2005, which is expressly incorporated herein by reference in its entirety.

BRIEF DESCRIPTION OF THE DRAWINGS

FIG. 3 is an overall view of the writing instrument of FIG. 1.

DETAILED DESCRIPTION OF THE PREFERRED EMBODIMENTS

Now, embodiments of the present invention will be explained with reference to drawings.

Figure 1:
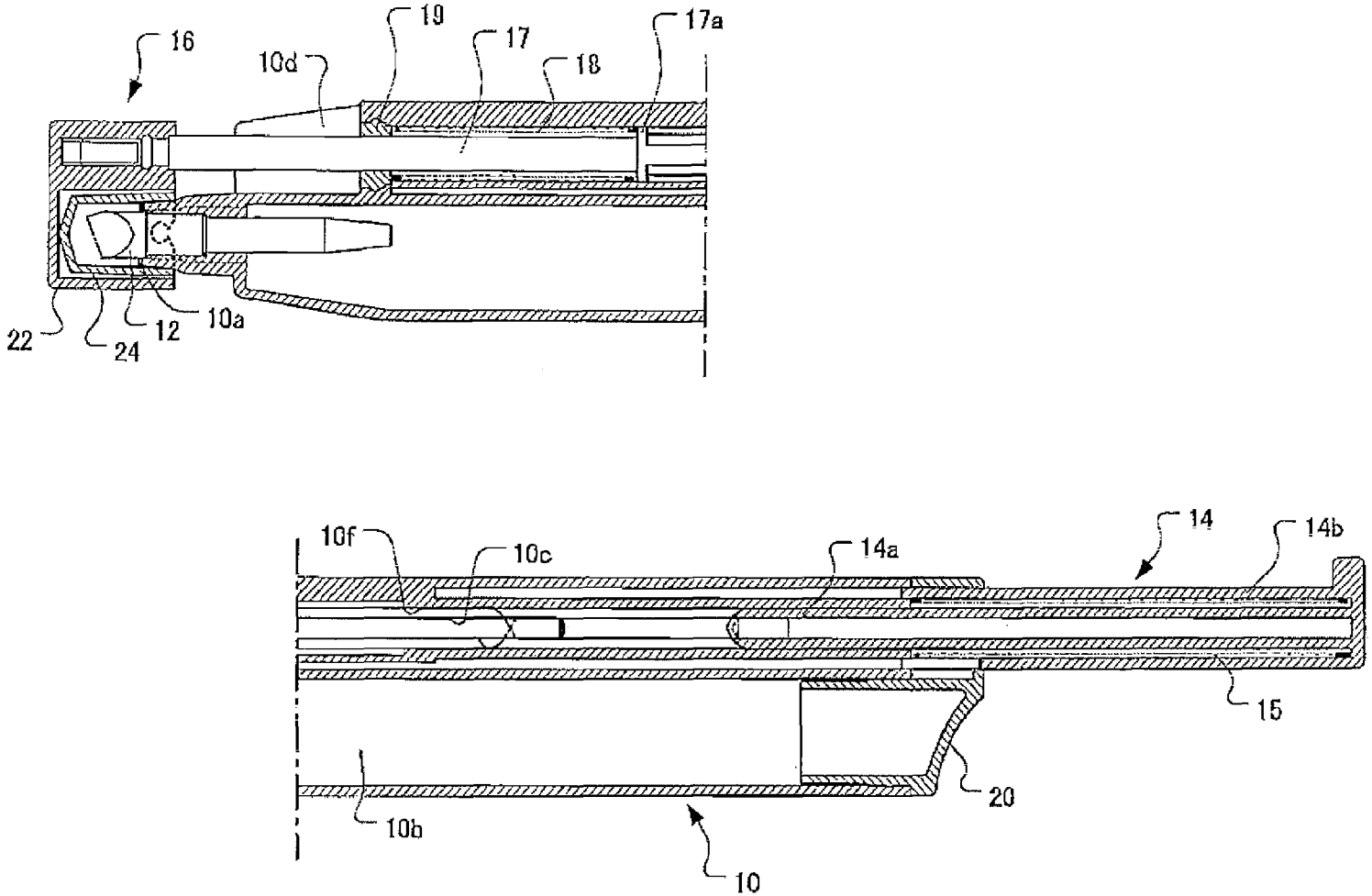
FIG. 1 is an overall sectional view showing an example, in which an airtight cap structure according to a first embodiment of the present invention is applied to a writing instrument.
Figure 2:
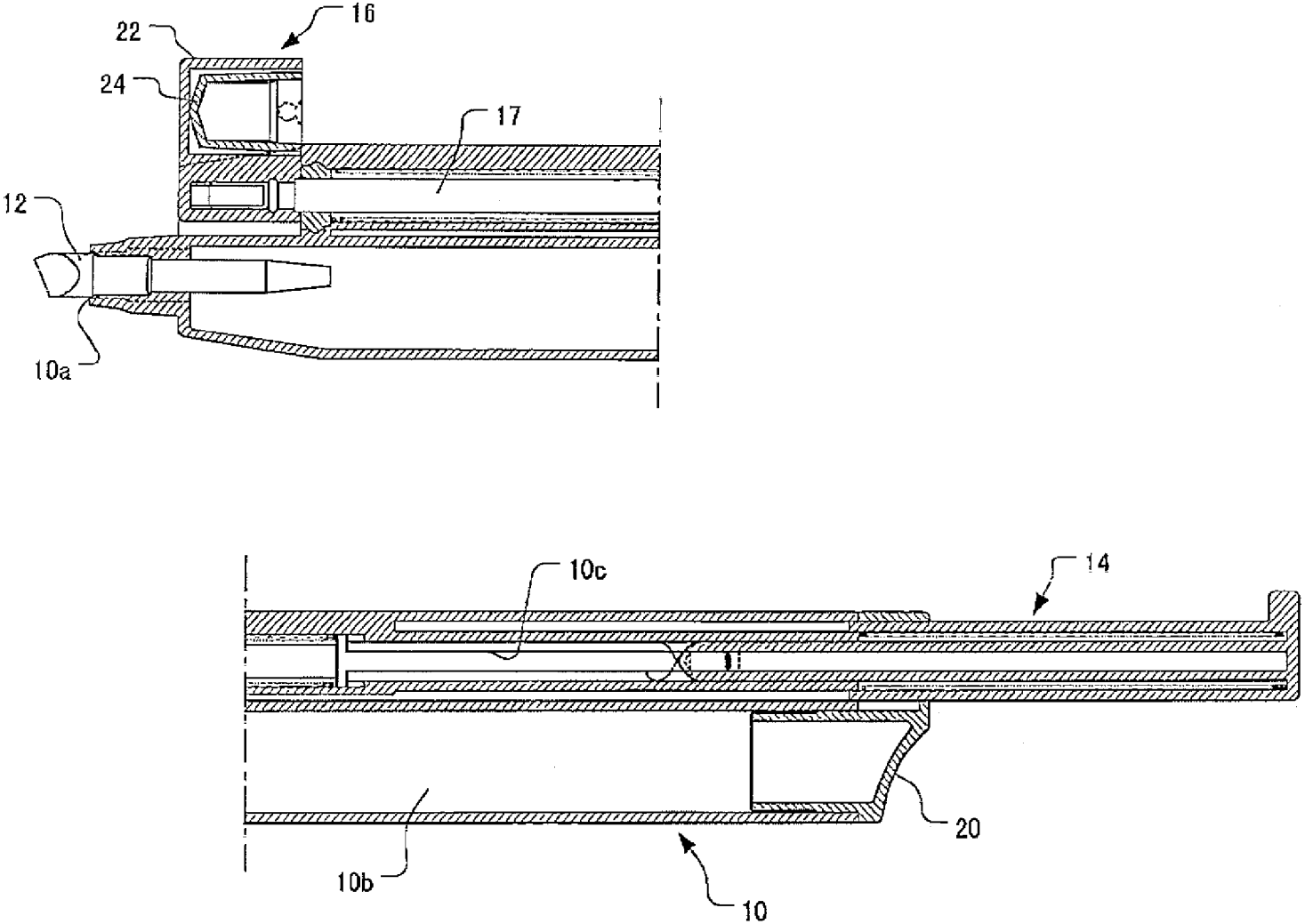
FIG. 2 is an overall sectional view showing an example, in which an airtight cap structure according to the first embodiment of the present invention is applied to a writing instrument.
Figure 3A:
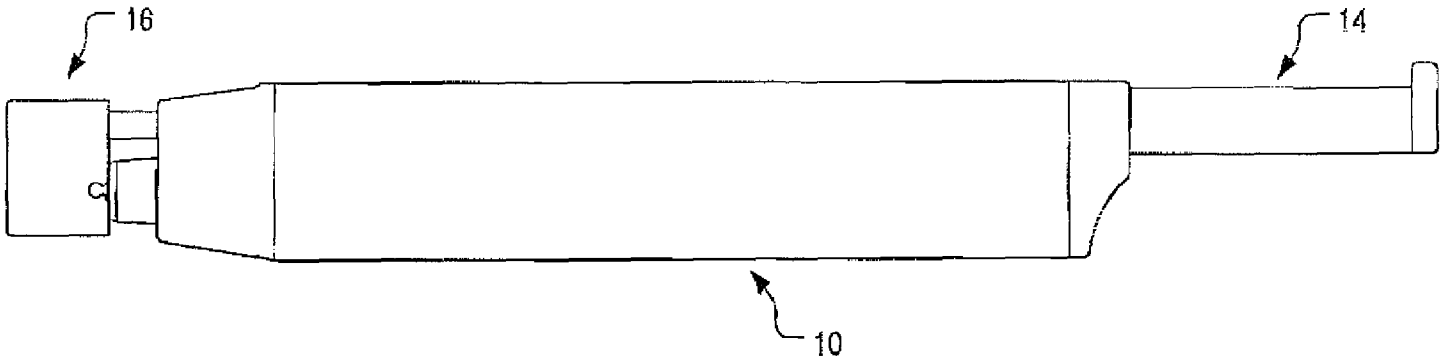
FIG. 3A shows a condition that a cap covers the tip.
Figure 3B:
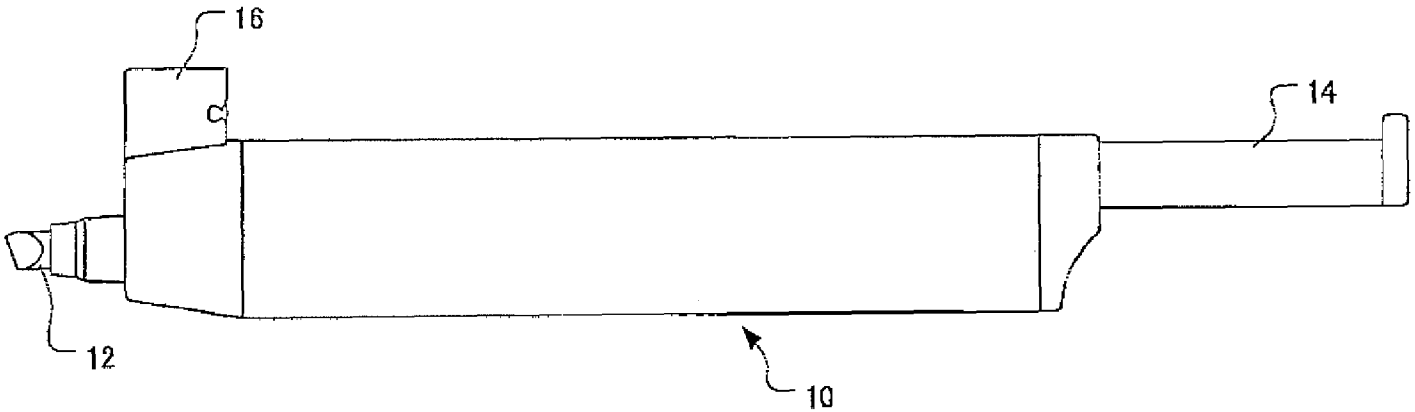
FIG. 3B shows a condition that the cap exposes the tip.

FIGS. 1 to 3 show an example, in which an airtight cap structure according to a first embodiment of the present invention is applied to a writing instrument. In FIGS. 1 to 3, the writing instrument has an axial sleeve 10 holding a tip 12 to be used, a cap 16 comprising a cap structure according to the present invention, and a knocking member 14 for operating of attaching and detaching the cap 16.

The tip 12 to be used, in this example, is a chip for a marker to transfer ink accommodated in a main axial hole 10*b* in the axial sleeve 10, and is fixed at a tip opening 10*a* of the main axial hole 10*b*. However, the tip 12 is not limited to it, but any tip can be applied which is suitable for arbitrary writing or applying media suitable for instruments for stationeries and cosmetics such as a ball-point pen, a fountain pen, an eye liner, a lip liner, an eye shadow chip, or like. For example, when the instrument is a ball-point pen, the tip 12 can comprise a ball, and when the instrument is a felt pen, the tip 12 comprises a core made of felt.

The tip 12, in this example, is integrally fixed to the axial sleeve 10, but is not limited to that. For example, when the tip 12 is an end of a refill, the tip 12 can be hold movably relative to the axial sleeve 10. Similarly, in the illustrated example, the axial sleeve 10 is constituted as a unitary part, but may be constituted of a plurality of parts.

The axial sleeve 10 is provided inside with a sliding axial hole 10*c* extending in an axial direction in parallel to the main axial hole 10*b*, and the knocking member 14 is arranged in the sliding axial hole 10*c* so as to movable in the axial direction of the hole 10*c*.

The front end of the knocking member 14 includes a knocking cam 14*a* to be inserted in the sliding axial hole 10*c*, and the rear end of the knocking member 14 includes a knocking operation part 14 *b* exposed from the axial sleeve 10. The knocking cam 14*a* and the knocking operation part 14*b* can be constituted as separate parts. The knocking operation part 14*b* can be knocked toward the axial sleeve 10, and the knocking cam 14*a* moves in the axial direction in the sliding axial hole 10*c* by the knocking operation. The knocking operation part 14*b* is always urged backward by a knocking spring 15, but is prevented from backward detachment from the axial sleeve 10.

A recess 10*d*, in which the cap 16 can be inserted, is formed at the front of the axial sleeve 10 adjacent to the tip opening 10*a* from which the tip 12 projects, and at least a part of the cap 16 can be accommodated in the recess 10*d*.

A rotary cam rod 17 is integrally connected with the cap 16. The rotary cam rod 17 extends backward from the cap 16, and can move in an axial direction in the sliding axial hole 10*c*. A return spring 18 is wound around the outer periphery of the rotary cam rod 17, and is interposed between a stopper 19 fixed near a tip inlet of the sliding axial hole 10*c* and a collar part 17*a* whose diameter is enlarged at the intermediate portion of the rotary cam rod 17, so as to always urge the rotary cam rod 17 and the cap 16 backward.

A tail plug 20 closing the rear end of the main axial hole 10*b* is mounted to the rear end of the axial sleeve 20.

Figure 4:
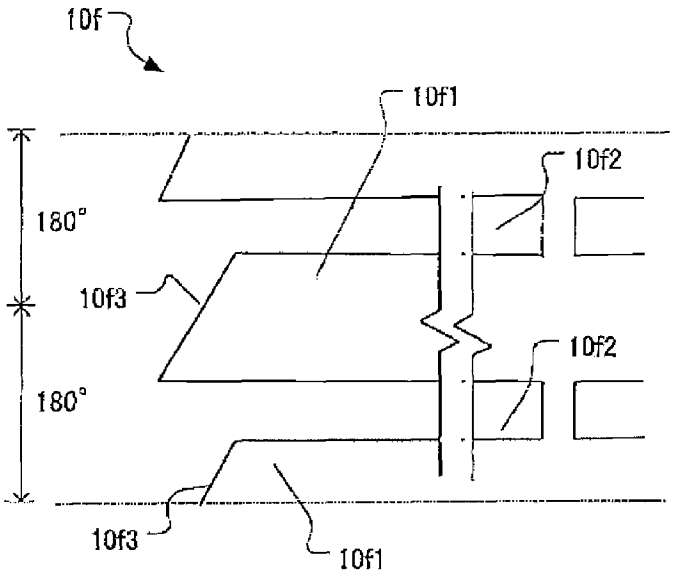
FIG. 4 is a developed view of a cam body.

The cap 16 is connected with the knocking member 14 via a rotation converting mechanism or a rotary cam mechanism, which comprises the rotary cam rod 17, a cam body 10*f* formed in the sliding axial hole 10*c*, the knocking cam 14*a* and the return spring 18 as an elastic body. That is to say, as shown in the developed view of FIG. 4, the cam body 10*f* includes ridges 10*f*1, 10*f*1 formed every 180 degrees, and vertical grooves 10*f*2, 10*f*2 as valleys formed between two adjacent ridges 10*f*1, 10*f*1. Cam surfaces 10*f*3, 10*f*3 faced to the front and inclined in the axial direction are formed at the front end of the ridges 10*f*1, 10*f*1.

Figure 5:
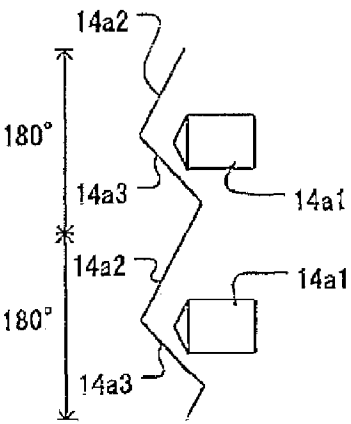
FIG. 5 is a developed view of a tip of a knocking cam.

On the other hand, as shown in the developed view of FIG. 5, protrusions 14*a*1, 14*a*1 are formed on the outer periphery of the knocking cam 14*a* every 180 degrees, and two kinds of cam surfaces 14*a*2, 14*a*3 inclined in the axial direction are formed on the front end surface of the knocking cam 14*a* every 180 degrees. The cam surfaces 14*a*2 are gently inclined while the cam surfaces 14*a*3 are steeply inclined. Both of the cam surfaces are faced to the front, and inclined in opposite directions. The protrusions 14*a*1, 14*a*1 are slidably fitted in the vertical grooves 10*f*2, 10*f*2 of the cam body 10*f*, so that the knocking cam 14*a* cannot rotate relatively to the sliding axial hole 10*c*, but can move in the axial direction.

Figure 6A:
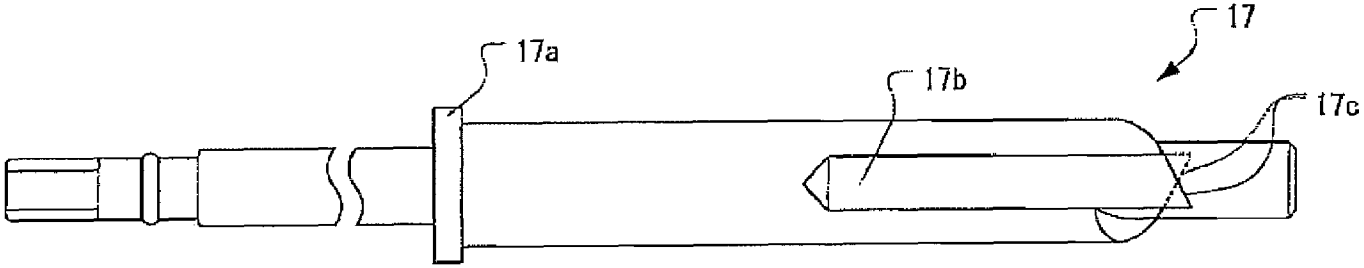
FIG. 6A is a plane view of a rotary cam rod.
Figure 6B:
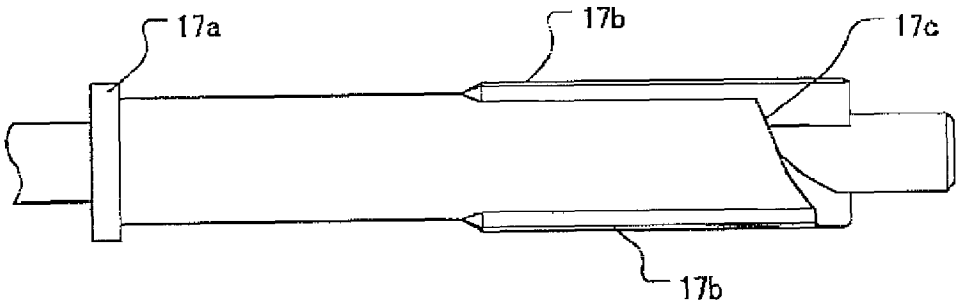
FIG. 6B is a partial side view thereof.

As shown in FIG. 6, two vertical ribs 17*b*, 17*b* are formed on the outer periphery backward of the collar part 17*a* of the rotary cam rod 17 at 180 degrees angularly spaced. The vertical ribs 17*b*, 17*b* are slidably fitted in the vertical grooves 10*f*2, 10*f*2 of the cam body 10*f*. Cam surfaces 17*c*, 17*c* are formed on the rear end surfaces of the vertical ribs 17*b*, 17*b*. The rotary cam rod 17 can move in the axial direction along the sliding axial hole 10*c*, and can rotate relatively to the sliding axial hole 10*c* when the vertical ribs 17*b*, 17*b* come out from the vertical grooves 10*f*2, 10*f*2 of the cam body 10*f* and located at the front.

Figures 7A, 7B, 7C:
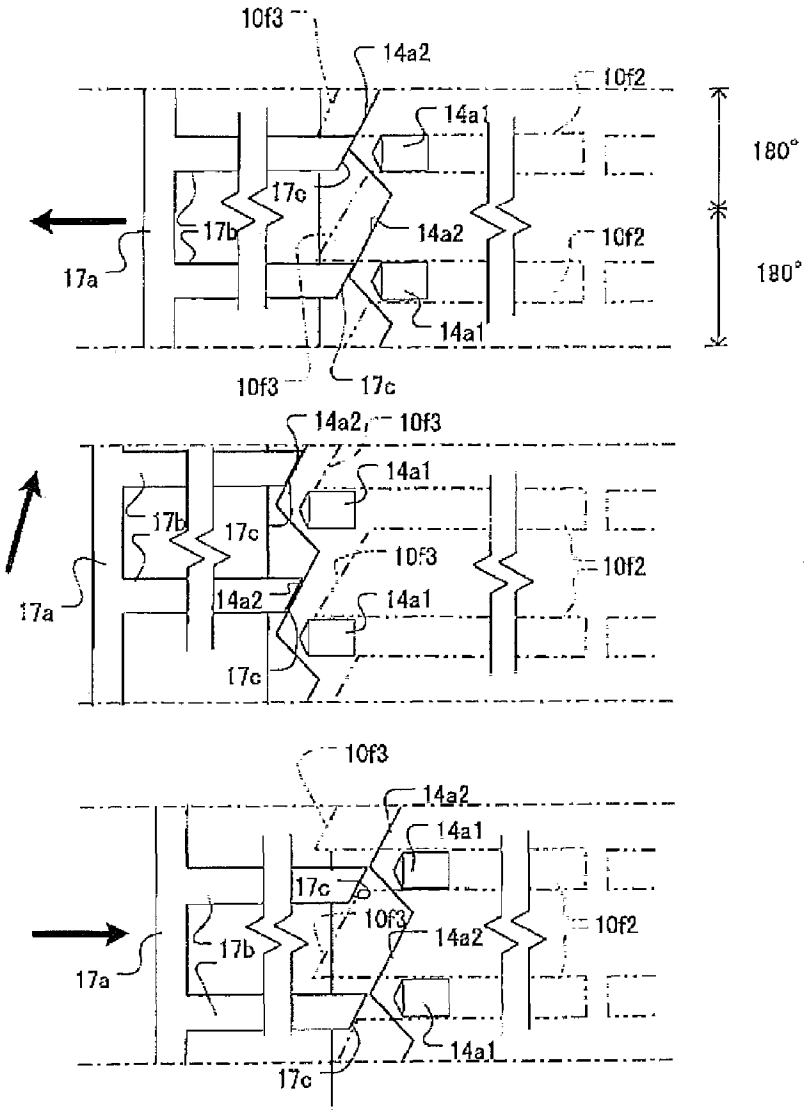
FIGS. 7A to 7C show operations of a rotation converting mechanism.

As shown in FIG. 7, when the knocking operation part 14*b* is knocked, the knocking cam 14*a* moves forward in the sliding axial hole 10*c*, and the tip of the knocking cam comes into contact with the rear end of the rotary cam end 17, so as to move the rotary cam rod 17 forward. When the vertical ribs 17*b*, 17*b* of the rotary cam rod 17 come out from the vertical grooves 10*f*2, 10*f*2 of the cam body 10, the cam surfaces 17*c*, 17*c* of the rotary cam rod 17 slide along the cam surfaces 14*a*2, 14*a*2 of the knocking cam 14*a* by an urging force of the return spring 18 together with this backward movement, so that the rotary cam rod 17 rotates. Furthermore, when a knocking force of the knocking operation part 14*b* is released, the cam surfaces 17*c*, 17*c* slide along the cam grooves 10*f*2, 10*f*2 of the cam body 10*f*, and the rotary can rod 17 rotates by 180 degrees. Thereafter, the vertical ribs 17*b*, 17*b* are fitted in the vertical grooves 10*f*2, 10*f*2 of the cam body 10 different from previous grooves by 180 degrees, and move backward.

As the rotary cam rod 17 moves forward, rotates by 180 degrees, and moves backward as described above, the cap 16 also moves forward, and it moves forward than the tip 12, rotates around the axial line of the rotary cam rod 17 as a rotational center by 180 degrees, moves backward, and is accommodated in the recess 10*d*. Thereby, the tip 12*a* of the refill 12 is exposed, so as to enable writing (see FIGS. 2 and 3B).

After completion of writing, when the knocking operation pact 14*b* is knocked again, as is similar to a previous case, the rotary cam rod 17 moves forward, rotates by 180 degrees and moves backward in cooperation with the knocking cam 14*a*, the cam body 10*f* and the rotary cam rod 17. Therefore, the cap 16 moves forward from the recess 10*d*, rotates around the axial line of the rotary cam rod 17 as a rotational center by 180 degrees, and moves backward, so as to cover the tip 12 (see FIGS. 1 and 3A).

As described above, when the cap 16 is attached or detached by a remote operation of the knocking operation part 14*b*, a mounting failure of the cap 16 sometimes occurs due to slight inclination or positional displacement between the cap 16 and the tip 12, which might lead to deterioration of airtightness of the tip 12.

Figure 8B:
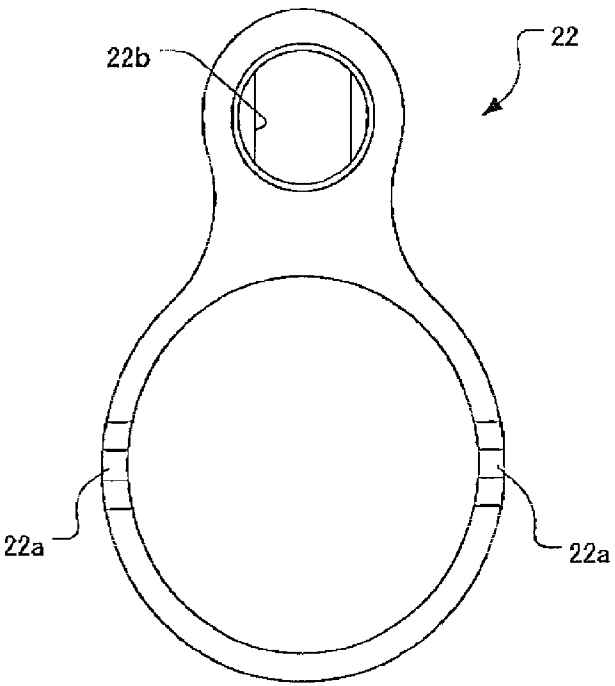
FIG. 8B is a view seen from a direction 8B of FIG. 8A.
Figure 8A:
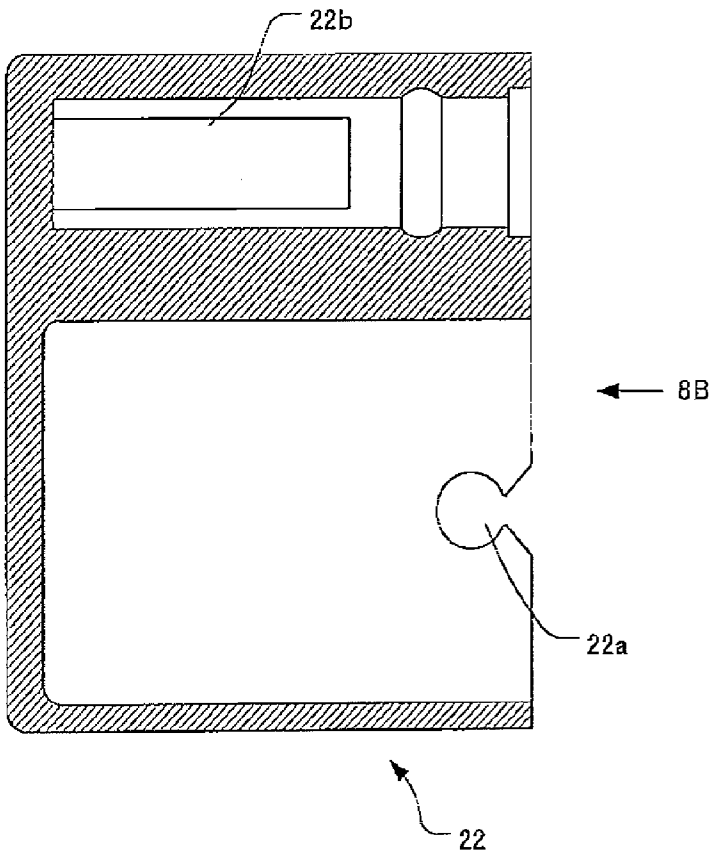
FIG. 8A is a sectional view of an outer cap.

Therefore, the cap 16 according to the present invention comprises an outer cap 22, and an inner cap 24 arranged inside a main body of the outer cap 22, and the inner cap 24 can be inclined relative to the central axial line of the cap against the outer cap 22. More particularly, as shown in FIG. 8, the outer cap 22 has shaft receiving holes 22*a*, 22*a* adjacent to an opening of the main body. Also, the cap 22 has a receiving hole 22*b* apart from the main body of the cap 22. The recessing hole 22*b* receives the tip of the rotary cam rod 17 in such a manner that it cannot rotate and cannot move in the axial direction relative to the rotary cam rod 17.

Figure 9B:
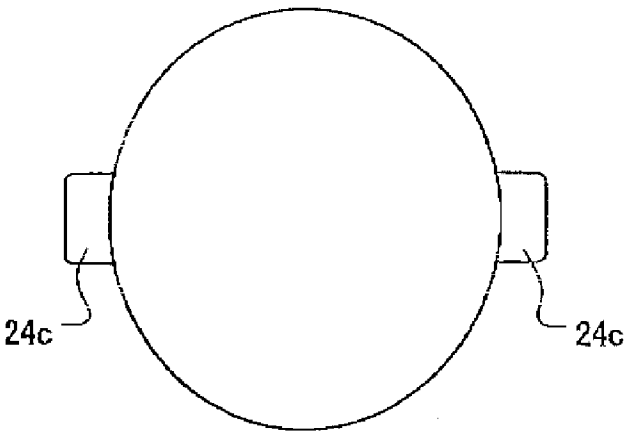
FIG. 9B is a view seen from a direction 9B of FIG. 9A.
Figure 9A:
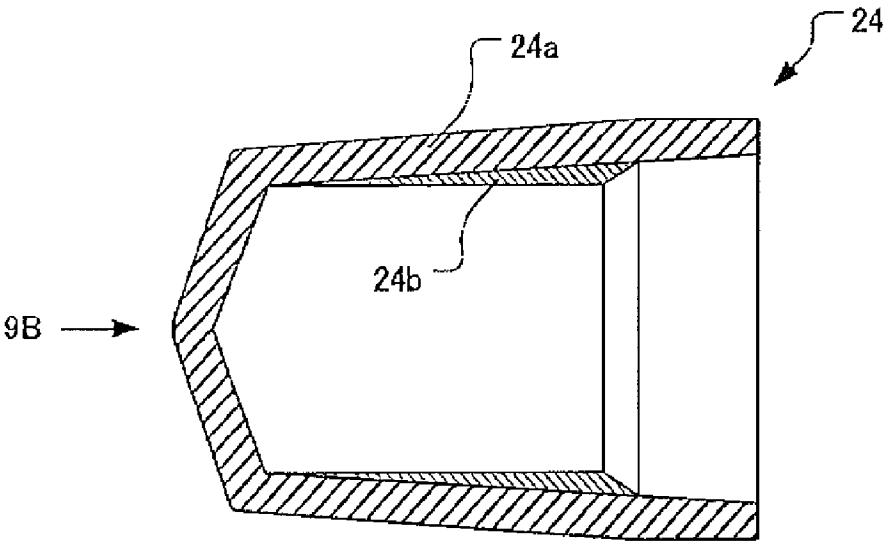
FIG. 9A is a sectional view of an inner cap.
Figure 10:
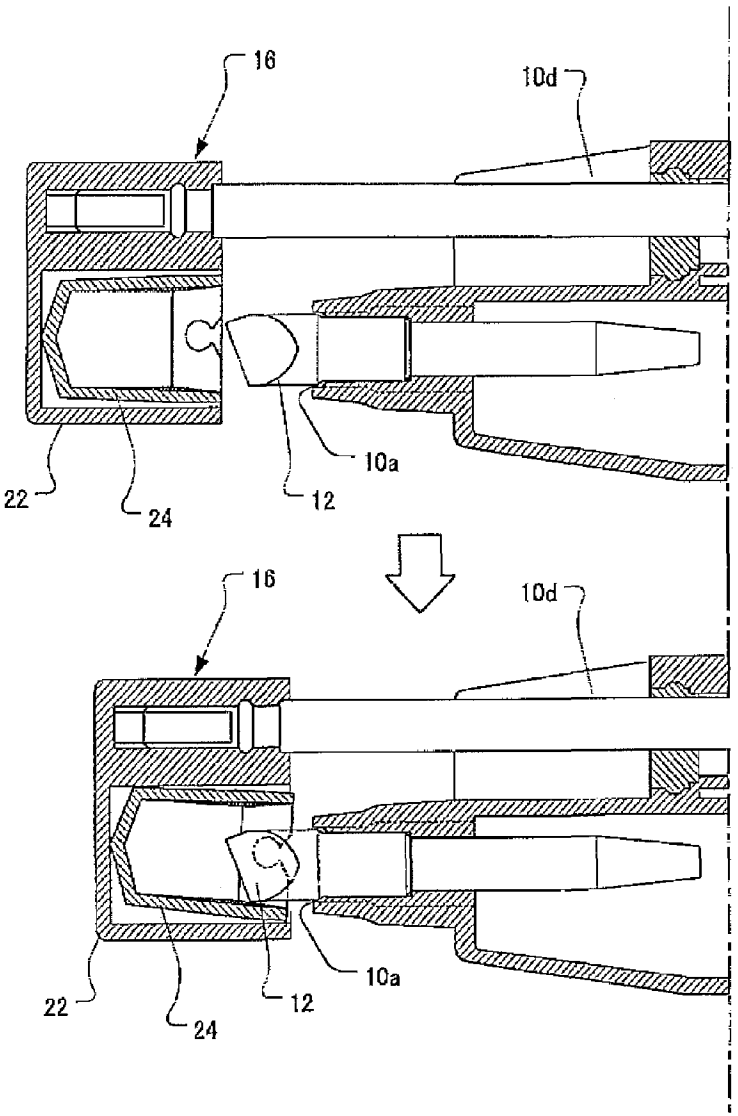
FIG. 10 is an enlarged view when the cap is mounted.

As shown in FIG. 9, the inner cap 24 is molded by two color molding, comprised of a hard part 24*a* made of hard resin, and a soft part 24*b* positioned inside the hard part 24*a* and made of elastic soft resin. The soft part 24*b* can be formed of thermoplastic elastomer and the like. Furthermore, shaft parts 24*c*, 24*c* which can be inserted in the shaft receiving holes 22*a*, 22*a* are projected on the outer periphery of the hard part 24*a* of the inner cap 24.

The shaft parts 24*c*, 24*c* of the inner cap 24 are fitted into the shaft receiving holes 22*a*, 22*a* of the outer cap 22, so that the inner cap 24 can rotate around the axis perpendicular to the central axial line of the cap 16 relative to the outer cap 22 with the shaft part 24*c* being a center.

Because the inner cap 24 can rotate relative to the outer cap 22, when the cap 16 is being mounted, even if the respective central axial lines of the cap 16 and the tip 12 are not aligned with each other, or the central axial lines of the cap 16 and tip 12 are inclined to each other, the inner cap 24 is adapted to the tip 12 while inclining to the central axial line of the cap, and corrects the position of the cap 16, as shown in FIG. 1. Therefore, the tip 12 is finally accommodated in the cap 16 at a right position, and the soft part 24*b* of the inner cap 24 surely comes into contact with the tip of the axial sleeve 10 around the tip 12, so that airtightness can be kept.

Instead of that the shaft receiving holes 22*a*, 22*a* are provided on the outer cap 22 and the shaft parts 24*a*, 24*a* are provided the inner cap 24, the shaft parts may be provided on the outer cap and the shaft receiving holes may be provided on the inner cap. Additionally, the outer cap and the inner cap may comprise a plurality of components, respectively. The inner cap may be entirely made of the soft material only.

Figure 11:
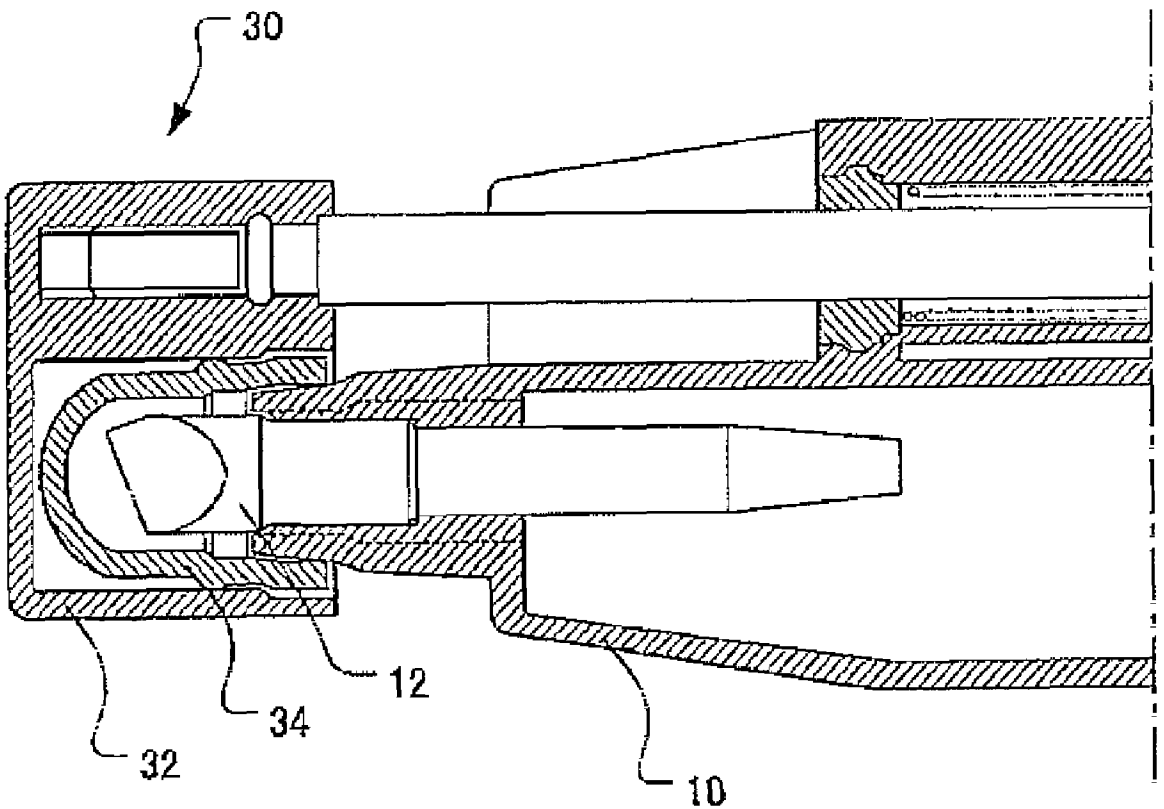
FIG. 11 is a partial enlarged sectional view showing an example, in which an airtight cap structure according to a second embodiment of the present invention is applied to a writing instrument.

Now, FIG. 11 is a sectional view showing an instrument, to which a cap structure in a second embodiment of the present invention is applied. In FIG. 11, identical members as those in the first embodiment are assigned respectively to the same reference numbers, and detailed explanation thereof will be omitted.

Figure 12B:
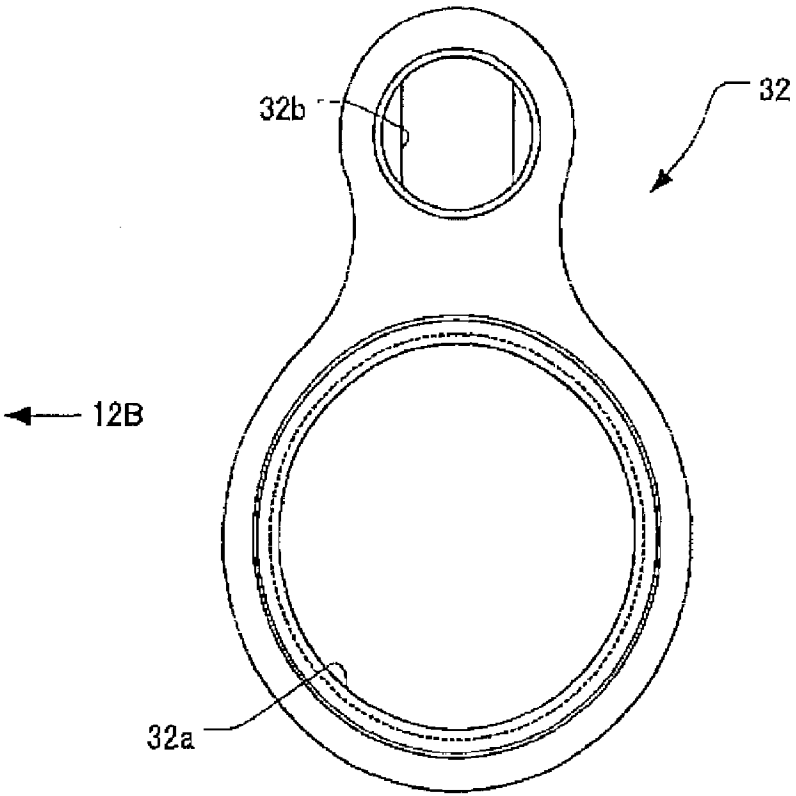
FIG. 12B is a view seen from a direction 12B of FIG. 12A.
Figure 12A:
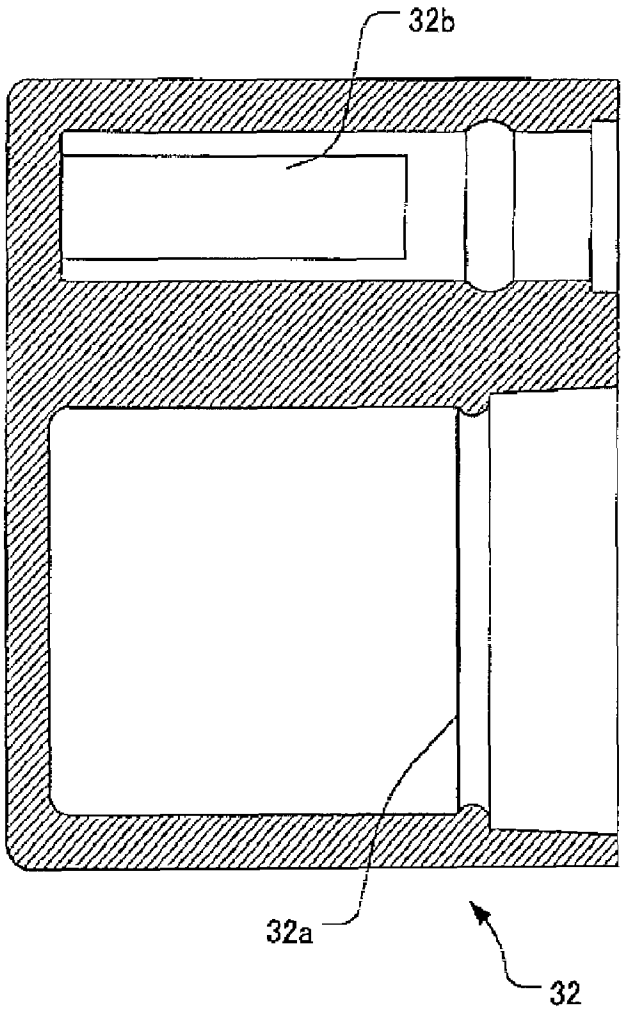
FIG. 12A is a sectional view of an outer cap.

A cap 30 according to a cap structure in this embodiment comprises an outer cap 32, and an inner cap 34 arranged inside the outer cap 32, and the inner cap 34 can swing relative to the outer cap 32. More particularly, as shown in FIG. 12, the outer cap 32 has an annular projection 32*a* on its inner periphery. Furthermore, the outer cap 32 has a receiving hole 32*b* apart from the main body. The receiving hole 32*b* receives the tip of the rotary cam rod 17 in such a manner that it cannot rotate and cannot move in the axial direction relative to the rotary cam rod 17.

Figure 13B:
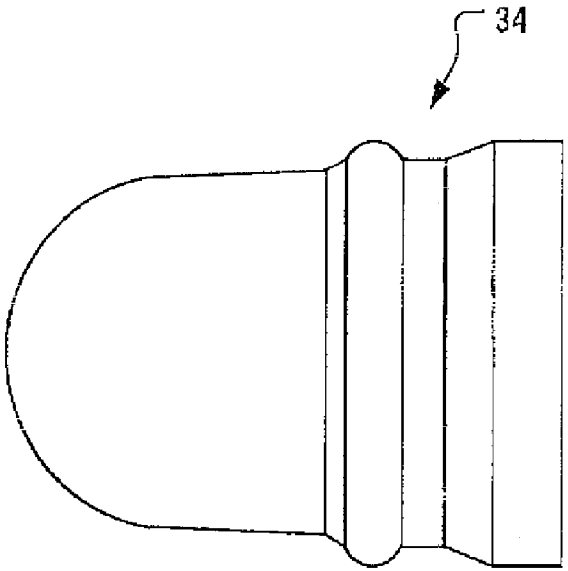
FIG. 13B is a side view thereof.
Figure 13A:
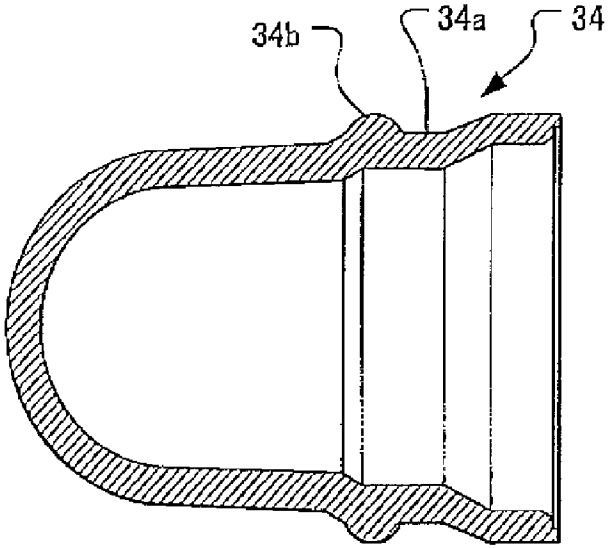
FIG. 13A is a sectional view of an inner cap.

As shown in FIG. 13, an annular recess 34*a* that can be fitted with the annular projection 32*a*, and an annular projection 34*b* adjacent to the annular recess 34*a* are formed on the outer periphery of the inner cap 34.

The annular projection 32*a* of the outer cap 32 is loosely fitted in the annular recess 34*a* of the inner cap 34 having a play, and the inner cap 34 can swing relative to the outer cap 32 with an annular contact line to the outer cap 32 of the annular projection 34*b* being a center. To smoothen this swinging movement, the surface of the annular projection 34*b* is curved as illustrated.

In this manner, swinging the inner cap 34 allows the inner cap 34 to incline relative to the central axial line of the cap so as to obtain operations and effects similar to those of the first embodiment.

The annular recess and the annular projection may be formed on any of the outer cap and the outer cap, respectively. Also, the outer cap and the inner cap may comprise a plurality of components, respectively. In this example, at least a part of inside part of the inner cap may be made of or whole soft material.

Figure 14:
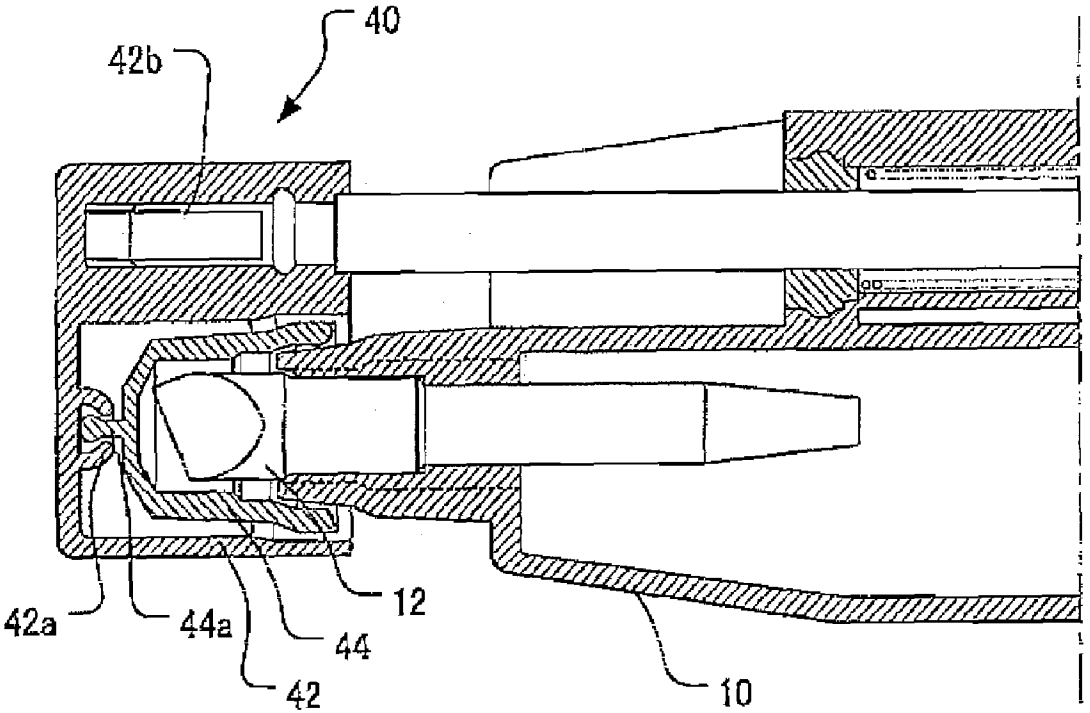
FIG. 14 is a partial enlarged sectional view showing an example, in which an airtight cap structure according to a third embodiment of the present invention is applied to a writing instrument.

Now, FIG. 14 is a sectional view showing a writing instrument, to which a cap structure in a third embodiment of the present invention is applied. In FIG. 14, identical members as those in the second embodiment are assigned respectively to the same reference numbers, and detailed explanation thereof will be omitted.

A cap 40 according to a cap structure in this embodiment comprises an outer cap 42, and an inner cap 44 arranged inside the outer cap 42, and the inner cap 44 can swing relative to the outer cap 42. More particularly, the outer cap 42 has a receiving part 42*a* on a peak rear inside of the main body of the outer cap. Furthermore, the outer cap 42 has a receiving hole 42*b* apart from the main body. The receiving hole 42*b* receives the tip of the rotary cam rod 17 in such a manner it cannot rotate and cannot move in the axial direction relative to the rotary cam rod 17.

A pivot part 44*a* that can be fitted with the receiving part 42*a* is formed on the peak top outside of the inner cap 44.

The tip of the pivot part 44*a* of the inner cap 44 is inserted into the receiving part 42*a* from the inlet thereof, so that the inner cap 44 can be inclined, namely pivoted in an arbitrary direction with a central axial line of the cap being a center, and can be pivoted to the outer cap 42. To smoothen this pivoting movement, an insertion end inserted in the receiving part 42*a* of the pivot part 44*a* is formed of a spherical shape, and serves as a spherical bearing.

In this manner, pivoting the inner cap 44 allows the inner cap 44 to incline relative to the central axial line of the cap so as to obtain operations and effects similar to those in the previous embodiments. The receiving part and the pivot part may be formed on any of the outer cap and the inner cap, respectively. Also, the outer cap and the inner cap may comprise a plurality of parts, respectively. In this example, the inside of at least a part of or whole inner cap may be made of a soft material.

The cap structure shown in the above-mentioned embodiments is one of application examples, in which the caps 16, 30, and 40 are attached or detached by a remote operation of the knocking operation part 14*b*, and is suitable for such application examples. However, needless to say, the cap structure can be similarly applied to a cap of a type in which the cap is operated directly by hands.

While the principles of the invention have been described above in connection with specific embodiments, and particular modifications thereof, it is to be clearly understood that this description is made only by way of example and not as a limitation on the scope of invention.

What is claimed is:

1. An airtight cap structure having a cap for detachably covering a tip to be used to prevent the tip from drying, wherein the cap comprises an outer cap and an inner cap installed in said outer cap, and the inner cap is mounted to the outer cap so that the inner cap can incline relative to a central axial line of the cap, and the inner cap comes into close contact with the tip or its periphery when the cap covers the tip used, wherein said inner cap is mounted to the outer cap so has to be rotatable around an axis perpendicular to axial line of the cap.

2. The airtight cap structure according to claim 1, comprising a pair of shaft parts formed on any one of peripheries of said inner cap and said outer cap and extending in a radial direction, and shaft receiving holes formed on the other of the peripheries of the inner cap and the outer cap and receiving said shaft parts.

3. The airtight cap structure according to claim 1, wherein said inner cap is mounted so as to be swingable around a annular part formed on the inner periphery of the outer cap.

4. The airtight cap structure according to claim 3, comprising an annular recess formed on any one of the peripheries of said inner cap and said outer cap, and a projection formed on the other of the peripheries of the inner cap and the outer cap and loosely fitted with said recess.

5. The airtight cap structure according to claim 1, wherein said inner cap is mounted to the outer cap so as to be pivotable around a central axial line of the cap.

6. The airtight cap structure according to claim 5, comprising a receiving part formed on any one of peak surfaces of said inner cap and said outer cap, and a pivot part formed on the other of the peak surfaces of the inner cap and the outer pap and pivoted to said receiving part.

7. An instrument comprising: a cap having the airtight cap structure according to claim 1; an axial sleeve holding a tip; a knocking member installed to the axial sleeve, said knocking member adapted to be knocked in an axial direction to attach and detach the cap from the axial sleeve; and a rotation converting mechanism connecting the cap with the knocking member wherein said rotation converting mechanism moves the cap forward, rotates the cap around an axis parallel to the axial direction, and then moves the cap backward in response to one knock in an axial direction of the knocking member, and every knock of the knocking member, the cap can be switched between a condition that the cap covers the tip, and a condition that the cap exposes the tip.

* * * * *